US006944963B2

(12) United States Patent
Amaru

(10) Patent No.: US 6,944,963 B2
(45) Date of Patent: Sep. 20, 2005

(54) PATTERN-PROFILE MEASURING DEVICE

(76) Inventor: Lily Marie Amaru, 901 S. 6th Ave., #101, Hacienda Heights, CA (US) 91745

( * ) Notice: Subject to any disclaimer, the term of this patent is extended or adjusted under 35 U.S.C. 154(b) by 0 days.

(21) Appl. No.: 10/757,002

(22) Filed: Jan. 13, 2004

(65) Prior Publication Data

US 2004/0143983 A1 Jul. 29, 2004

Related U.S. Application Data

(60) Provisional application No. 60/440,226, filed on Jan. 15, 2003.

(51) Int. Cl.[7] ..... B43L 13/20

(52) U.S. Cl. ..... 33/492; 33/645; 33/562; 33/566

(58) Field of Search ..... 33/492, 758, 759, 33/613, 645, 562, 563, 566

(56) References Cited

U.S. PATENT DOCUMENTS

| | | | | | |
|---|---|---|---|---|---|
| D163,411 | S | * | 5/1951 | Picken | D10/64 |
| 3,071,171 | A | * | 1/1963 | Guerrero | 33/524 |
| 3,673,052 | A | * | 6/1972 | Small et al. | 156/164 |
| 4,022,139 | A | * | 5/1977 | Carson | 112/150 |
| 4,053,986 | A | * | 10/1977 | Axelrod | 33/17 R |
| 4,386,980 | A | * | 6/1983 | Fitzpatrick et al. | 156/63 |
| 4,502,232 | A | * | 3/1985 | Broders | 33/527 |
| 4,642,896 | A | * | 2/1987 | Grimm | 33/17 R |
| 4,646,666 | A | * | 3/1987 | Burrier | 112/475.22 |
| 4,912,850 | A | * | 4/1990 | Gray | 33/1 G |
| 4,945,642 | A | * | 8/1990 | Saulietis | 33/17 R |
| 5,230,762 | A | * | 7/1993 | Horikiri | 156/250 |
| 5,319,859 | A | * | 6/1994 | Smith | 33/563 |
| 5,557,996 | A | * | 9/1996 | Reber et al. | 83/56 |
| 5,579,670 | A | * | 12/1996 | McCormick | 83/56 |
| 5,638,605 | A | * | 6/1997 | Sligar | 33/494 |
| 5,749,149 | A | * | 5/1998 | Claytor | 33/1 F |
| 5,791,062 | A | * | 8/1998 | Walker | 33/563 |
| 5,813,127 | A | * | 9/1998 | Blevins | 33/492 |
| 5,926,966 | A | * | 7/1999 | Russell | 33/562 |
| 5,943,974 | A | * | 8/1999 | Hoag | 112/475.01 |
| 5,966,824 | A | * | 10/1999 | Vazquez | 33/11 |
| 6,112,425 | A | * | 9/2000 | Nelson et al. | 33/566 |
| 6,321,458 | B1 | * | 11/2001 | Hess | 33/566 |
| 6,357,370 | B1 | * | 3/2002 | Fritz et al. | 112/475.01 |

OTHER PUBLICATIONS

One page printout from Borderlines Rules—Used as early as May 2001.
One page printout from Borderlines Rules—Jan. 28, 2003.
One page printout from—Borderlines Patters 'n Letters Rulers—Apr. 27, 2004.

* cited by examiner

*Primary Examiner*—Christopher W. Fulton
*Assistant Examiner*—Amy R. Cohen
(74) *Attorney, Agent, or Firm*—Brouse McDowell; Roger D. Emerson; Heather M. Barnes

(57) ABSTRACT

This invention pertains to the art of methods and apparatuses associated with measuring and profile tools utilized in crafts, particularly in the design of quilts. More specifically, the invention provides an improved measuring tool that incorporates a variety of undulating profiles and is useful in the construction of quilts of other items of craftsmanship that incorporate non-linear, undulating, curving or wavy profiles.

13 Claims, 2 Drawing Sheets

PATTERN-PROFILE MEASURING DEVICE

This application claims priority to a provisional patent application having Ser. No. 60/440,226 filed Jan. 15, 2003.

I. BACKGROUND OF THE INVENTION

A. Field of Invention

This invention pertains to the art of methods and apparatuses associated with measuring and profile tools utilized in crafts, particularly in the design of quilts, and clothing. More specifically, the invention provides an improved measuring tool that incorporates a variety of undulating profiles and is useful in the construction of quilts of other items of craftsmanship that incorporate undulating, curving, wavy or non-linear profiles.

B. Description of the Related Art

Straight edge rules are well known in the art. People engaged in crafts use straight edge rulers extensively to mark lengths, lines and angles. In quilting, the use of straight edges is central to creating the geometric designs that are incorporated into the quilt and often define the quilt under construction. Quilt construction is based on a foundation of individual fabric elements that are joined together at the edges, typically by sewing, to form blocks, which blocks are joined together to form the larger blanket. If the edges of the individual fabric elements do not align properly, the design of the quilt can quickly become skewed, making the task of carrying out a quilt design very difficult. Small errors in the joining of individual fabric elements can be compounded over the course of several blocks, particularly if an error in laying out the edges of the fabric elements is repeated. The result in such cases is often a quilt whose geometric design is uneven.

For reasons of simplicity in preparing consistently sized and shaped fabric elements, it is typically the case that quilt makers rely on fabric elements that have only straight edges, including fabric squares, rectangles, triangles and parallelograms. These elements are easy to create with a straightedge ruler and a rotary cutter. However, many beautiful designs can be created, in quilt making as well as a variety of other artistic crafts and disciplines, by incorporating the design element of a wave or undulating contour. In quilting in particular, fabric elements having wavy or undulating edges may be joined together into larger blocks and, ultimately, into a quilt that has a tremendous amount of visual interest because of the non-linear design. While it is relatively easy to ensure that fabric elements having straight edges will join properly, it is a difficult task to ensure that fabric elements having wavy or undulating edges match up to the degree necessary to create a quilt comprised of as many as several hundreds of such elements. While undulating contours can be drawn by hand using a straight edge to define an axis and points spaced periodically at the crest and trough of each wave, this method of producing waves is wrought with risk of inconsistency and error. Therefore, what is needed is a measuring tool that also provides one or more edges defining a wave pattern or other series of undulations so that a repeated pattern of these undulations can be reproduced and cut on fabric swaths and so that the edges of these fabric pieces will join together accurately.

The present invention, therefore, provides improved methods and apparatuses for reproducing undulating contours on fabric or other material so that these elements, if desired, can be joined together in a consistent fashion to produce a design comprised of wavy elements.

II. SUMMARY OF THE INVENTION

According to one aspect of the present invention, a new and improved pattern-profile device is provided which permits an associated user to mark repeating undulating, wavy lines, or other non-linear patterns on material.

According to another aspect of the invention, the pattern-profile device also operates as a ruler to assist an associated user in measuring material.

According to a further aspect of the invention, the pattern-profile device defines multiple different undulating patterns so as to permit an associated user with a variety of different patterns to incorporate into an associated workpiece.

One advantage of this invention is that the pattern-profile device provides an easy means for routinely and accurately reproducing undulating or wavy lines on an associated workpiece.

The present invention is a pattern profile measuring device comprising a body having at least a first non-linear edge, the first non-linear edge is adapted to be used to make a portion of an associated fabric pattern, wherein the fabric portion has an edge such that the shape of the fabric portion edge resembles the first non-linear edge.

Another object of the present invention is to provide a pattern profile measuring device wherein the body further comprises a second non-linear edge.

Still yet, another object of the present invention is to provide a pattern profile measuring device wherein the second non-linear edge is adapted to be used to make a portion of the fabric pattern, wherein the shape of the fabric portion edge resembles the second non-linear edge.

Further, another object of the present invention is to provide a pattern profile measuring device wherein the first non-linear edge is different from the second non-linear edge.

Yet, another object of the present invention is to provide a pattern profile measuring device wherein the body further comprises demarcations for measuring length.

Another object of the present invention is to provide a pattern profile measuring device wherein the first non-linear edge is a wavy pattern.

Further, another object of the present invention is to provide a pattern profile measuring device wherein the second non-linear edge is a wavy pattern.

Still yet, another object of the present invention is to provide a pattern profile measuring device wherein the first non-linear edge is adapted to be used to make associated fabric blocks for the fabric pattern.

Another object of the present invention is to provide a pattern profile measuring device wherein the second non-linear edge is adapted to be used to create an associated outside edge of the fabric pattern.

It is yet another object of the present invention to provide a pattern profile measuring device wherein the fabric pattern is a quilt.

Another object of the present invention is to provide a method for making a fabric pattern, comprising the steps of:

(a) providing a pattern measuring device comprising a rigid body having a longitudinal axis, a first non-linear edge having a first wavelength and a second non-linear edge of having a second wavelength, said first wavelength and second wavelength being different, a first aligning gauge line proximate said first non-linear edge, a second aligning gauge line proximate said second non-linear edge, said first aligning gauge line and said second aligning gauge line being substantially parallel to said longitudinal axis;

(b) providing pieces of fabric, each of said pieces having an edge;

(c) cutting at least two pieces of said fabric;

(d) overlapping the edges of the two pieces of fabric a predetermined amount such that the edge of the first piece of fabric is underneath the second piece of fabric and the edge of the second piece of fabric is on top of the first piece of fabric;

(e) positioning said first non-linear edge of said pattern measuring device over said fabric such that said first aligning gauge line is coincident with the edge of the second piece of fabric;

(f) cutting said fabric along said first non-linear edge such that said fabric edges have a non-linear pattern;

(g) mating said non-linear edge of said first piece of fabric with said non-linear edge of said second piece of fabric;

(h) sewing said non-linear edges together, (i) forming a visible seam between said non-linear edges;

(j) repeating steps (c) to (i) to form a block of fabric using only said first non-linear edge of said pattern measuring device;

(k) forming a plurality of fabric blocks; and (l) sewing said fabric blocks together to create a fabric pattern having a visible non-linear pattern.

Another object of the present invention is to provide a method wherein the first non-linear edge is a wavy pattern.

Still yet, another object of the present invention is to provide a method wherein the step of mating the non-linear edge of the first piece of fabric with the non-linear edge of the second piece of fabric further comprises the step of mating a crest of the first piece of fabric with a trough of the second piece of fabric.

Further, another object of the present invention is to provide a method wherein the fabric pattern is for a place-mat.

Yet another object of the present invention is to provide a method wherein the fabric pattern is for a pillow.

It is yet another object of the present invention to provide an apparatus, comprising a rigid body having a longitudinal axis, at least a first non-linear edge baying a first wavelength, a second non-linear edge having a second wavelength, said first wavelength being different from said second wavelength, a first aligning gauge line proximate said first non-linear edges a second aligning gauge line proximate said second non-linear edge, said first aligning gauge line and said second aligning gauge line being substantially parallel to said longitudinal axis, said first non-linear edge adapted to be used to make a portion of an associated fabric pattern, wherein the fabric portion has an edge such that the shape of the fabric portion edge resembles said first non-linear edge, wherein said first non-linear edge is adapted to be used to make associated fabric blocks for the fabric pattern, said shape of the fabric portion edge resembling said first non-linear edge is adapted to be visible in the fabric block, wherein said first aligning gauge line and said second aligning gauge line are adapted to aid in positioning said body relative to the fabric portion so as to form consistently sized non-linear patterns in the fabric block.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

IV. DESCRIPTION OF THE PREFERRED EMBODIMENT

Figure 1:
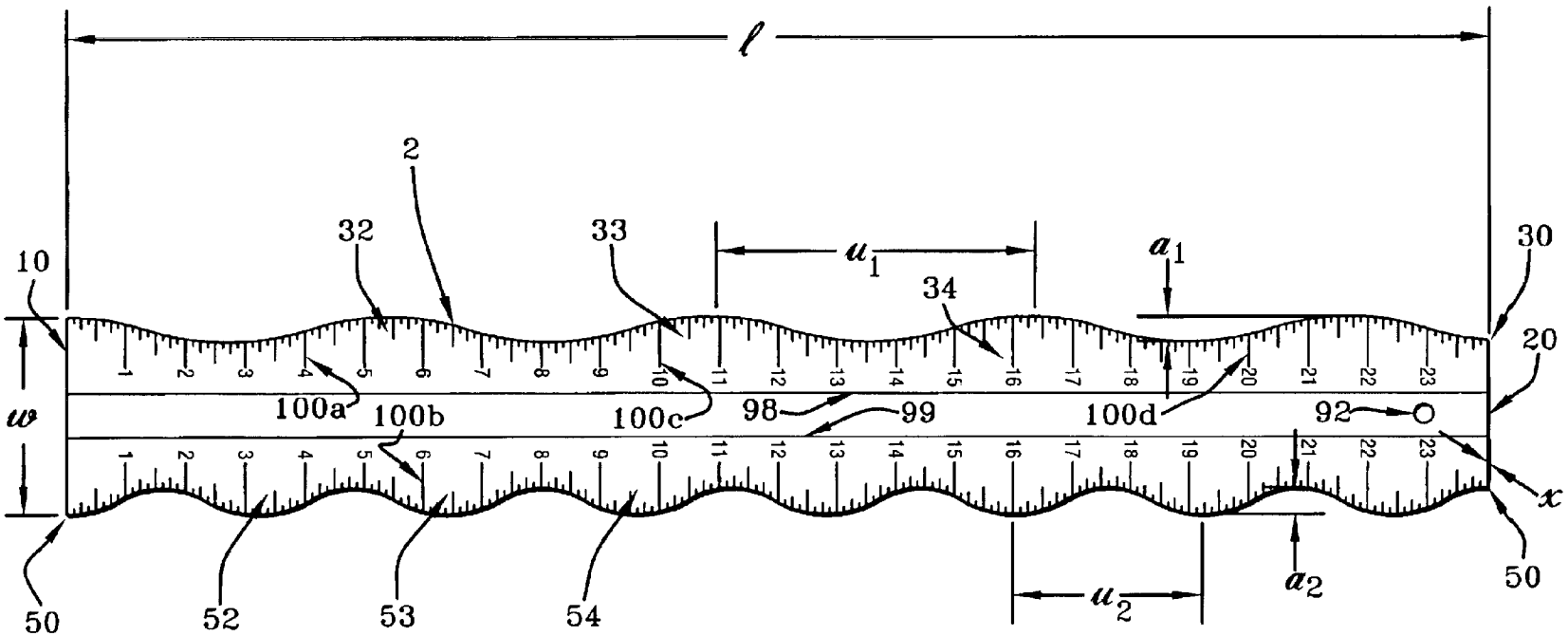
FIG. 1 is a plan view of the pattern-profile measuring device.

Referring now to the drawings wherein the showings are for purposes of illustrating a preferred embodiment of the invention only and not for purposes of limiting the same, FIG. 1 shows a pattern-profile measuring device 2 having a length l and a width w. The device 2 has a first side 10 and a second side 20, which first and second sides 10, 20 may be approximately parallel. The device 2 further has a first non-linear pattern edge 30 and a second non-linear pattern edge 50. A first aligning gauge line 98 may be imprinted, by means selected with sound engineering judgment, along the length l of the device 2. A second aligning gauge line 99 may also be imprinted on the device 2. The gauge lines 98, 99 aid the use I positioning the device relative to the fabric (not shown). Rule lines 100*a*, 100*b*, 100*c*, 100*d*, may be imprinted on the device 2 extending perpendicularly inwardly from each of the first and second pattern edges 30, 50. These rule lines 100*a*, 100*b*, 100*c*, 100*d* may demarcate inches and portions thereof, or alternatively, may define metric measures. The device 2 is approximately rectangular; however, it is contemplated that the device could be approximately "L"-shaped or "T"-shaped, having one or more additional "arms" extending from the device 2. The additional arms may provide additional edges for further patterns. Any other shape of the device 2 selected with sound engineering judgment may also be selected. The device 2 may have mounting means 92, such as a hole, hook or screw for mounting the device 2 on an associated wall, door or other similar location.

The device 2 may be constructed out of a transparent, sturdy material, such as plastic, tempered glass or acrylic. The material selected may be impact or shatter resistant; however, any suitable material may be selected with sound engineering judgment. The device 2 may be transparent in order to permit viewing of the rule lines 100*a*, 100*b*, 100*c*, 100*d* and the gauge lines 98, 99 on the associated material placed underneath the device 2.

The length l may be 24 inches; however, the length l may be in the range of approximately 6 inches to 48 inches. The width w of the device 2 may vary along the length l depending on the interaction between the first pattern edge 30 and the second pattern edge 50. However, the width w may be a minimum of approximately 1.0 inches in order to ensure sufficient rigidity of the device 2. Alternatively, the width w as well as the length l of the device 2 may be any measure of distance selected with sound engineering judgment. The device 2 may have a thickness t of approximately 0.125 inches. The thickness t may be in the range of approximately 0.1 inches to 0.50 inches or may be any thickness selected with sound engineering judgment so that the device 2 maintains sufficient rigidity to withstand the sideways pressure of an associated rotary cutter without deforming.

Figure 2:
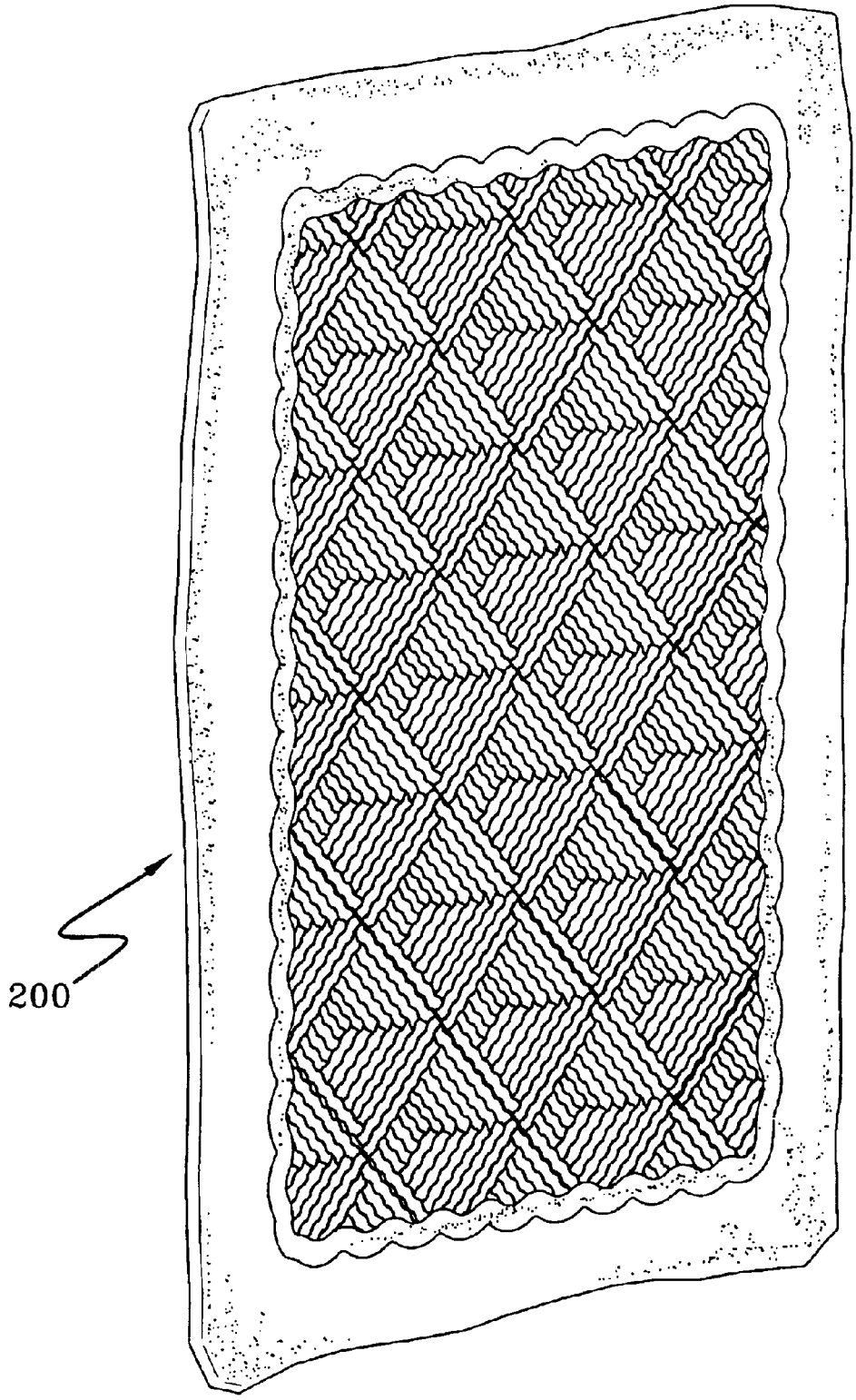
FIG. 2 is a plan view of a quilt constructed using the present invention.

With continuing reference to FIGS. 1 and 2, the first pattern edge 30 may be generally in the form of an undulating pattern comprised of at least a first wave or a plurality of waves 32, 33, 34. The first wave 32, 33, 34 may have a first amplitude a1 and a first wavelength u1. The first amplitude a1 of the first wave 32, 33, 34 may be equal between each of the first waves 32, 33, 34. The first amplitude a1 may be approximately 0.25 inches; however, it is contemplated that the first amplitude a1 may be in the range of approximately 0.1 inches to 2.0 inches. Similarly, the first wavelength u1 of the first wave 32, 33, 34 may be equal between each of the first waves 32, 33, 34. The first wavelength u1 may be approximately 5.25 inches; however, the first wavelength u1 may be in the range of approximately 1.0 inch to 12 inches. Any measure of first amplitude a1 and first wavelength u1 selected with sound engineering judgment may alternatively be used. It is also contemplated that the first pattern edge 30 may be comprised of a more complex structure having waves of differing wavelength and amplitude interposed atop one another in an array.

The second pattern edge 50 may be generally in the form of an undulating pattern comprised of at least a second wave or a plurality of waves 52, 53, 54, the second wave 52, 53, 54 having a second amplitude a2 and a second wavelength u2. As previously discussed, the second amplitude a2 of the second wave 52, 53, 54 may be equal between each of the second waves 52, 53, 54. The second amplitude a2 may be approximately 0.33 inches; however, it is contemplated that the second amplitude a2 may be in the range of approximately 0.1 inches to 2.0 inches. Similarly, the second wavelength u2 of the second wave 52, 53, 54 may be equal between each of the second waves 52, 53, 54. The second wavelength u2 may be approximately 4.25 inches; however, the second wavelength u2 may be in the range of approximately 1.0 inch to 12 inches. Any measure of second amplitude a2 and second wavelength u2 selected with sound engineering judgment may alternatively be used. It is further contemplated that the second pattern edge 50 may be comprised of a more complex structure having waves of differing wavelength and amplitude interposed atop one another in an array.

The second pattern edge 50 may be identical to the first pattern wave edge 30; however, it is contemplated that to provide a more diverse device 2, the second pattern edge 50 may be different than the first pattern wave edge 30, having a second wave 52, 53, 54 with a differing second amplitude a2 and second wavelength u2 than the first amplitude a1 and the first wavelength u1 of the first wave 32, 33, 34. It is also contemplated to be within the scope of the present invention that the first and second edges 30, 50 may take the form of any non-linear configuration.

To utilize the present invention, the apparatus described herein is provided. Further, the user obtains fabric or some suitable material. The user ensures that its cutting mat (not shown) measures correctly to "square up" fabric blocks that will be constructed. Note that the method now described refers to the non-linear edge being a wavy pattern. It should be understood that this methodology will apply to any non-linear edge that is utilized. The fabric is cut to a predetermined width, such as 2½ inches, or any other desired width. Two pieces of fabric are positioned in an overlapping orientation, preferably in the amount of one inch, although not limited thereto. The device is positioned over the fabric with the first non-linear edge over the overlapping section. The user cuts the fabric with any means chosen with sound engineering judgment, such as, but not limited to a rotary cutter. This cut results in the two pieces of fabric having the same non-linear profile. Next, the two pieces of fabric are positioned one over the other such that the crests and troughs of the wavy profile are aligned. In order to more easily sew the two pieces of fabric together, the user clips the troughs. Preferably, although not required, the clippings should not be more than ⅛ inch deep and ⅜ inch apart. Continuing with the foregoing novel method, the two fabric pieces are repositioned so that the crests of the first fabric mate with the troughs of the second fabric pieces. The user sews the two pieces together along the undulating profile, such that the seam may be visible between the two pieces of fabric. The user may continue to add pieces until a desired fabric block is complete. As the fabric block is assembled, the cutting mat may be utilized to ensure the fabric block is square. As fabric blocks are made, they may be sewn together to form a fabric pattern in the form of a quilt 200, placemat, pillow covering, or clothing, or any other application chosen in accordance with sound engineering judgment, as shown in FIG. 2. The user may also use the second non-linear side to create the outside edge of the fabric pattern.

The preferred embodiments have been described, hereinabove. It will be apparent to those skilled in the art that the above methods may incorporate changes and modifications without departing from the general scope of this invention. It is intended to include all such modifications and alternatives in so far as they come within the scope of the appended claims or the equivalents thereof.

Having thus described the invention, it is now claimed:

1. An apparatus, comprising:

a rigid body having a longitudinal axis, at least a first non-linear edge having a first wavelength, a second non-linear edge having a second wavelength, said first wavelength being different from said second wavelength, a first aligning gauge line proximate said first non-linear edge, a second aligning gauge line proximate said second non-linear edge, said first aligning gauge line and said second aligning gauge line being substantially parallel to said longitudinal axis, said first non-linear edge adapted to be used to make a portion of an associated fabric pattern, wherein the fabric portion has an edge such that the shape of the fabric portion edge resembles said first non-linear edge, wherein said first non-linear edge is adapted to be used to make associated fabric blocks for the fabric pattern, said shape of the fabric portion edge resembling said first non-linear edge is adapted to be visible in the fabric block, wherein said first aligning gauge line and said second aligning gauge line are adapted to aid in positioning said body relative to the fabric portion so as to form consistently sized non-linear patterns in the fabric block.

2. The apparatus of claim 1, wherein said second non-linear edge is adapted to be used to make a portion of the fabric pattern, wherein the shape of the fabric portion edge resembles said second non-linear edge.

3. The apparatus of claim 1, wherein the shape of said first non-linear edge is different from the shape of said second non-linear edge.

4. The apparatus of claim 1, wherein said body further comprises demarcations for measuring length.

5. The apparatus of claim 1, wherein said first non-linear edge is a wavy pattern.

6. The apparatus of claim 1, wherein said second non-linear edge is a wavy pattern.

7. The apparatus of claim 1, wherein said second non-linear edge is adapted to be used to create an associated outside edge of the fabric pattern.

8. The apparatus of claim 1, wherein said body further comprises a first aligning gauge line.

9. A method for making a fabric pattern, comprising the steps of:

(a) providing a pattern measuring device comprising a rigid body having a longitudinal axis, a first non-linear edge having a first wavelength and a second non-linear edge of having a second wavelength, said first wavelength and second wavelength being different, a first aligning gauge line proximate said first non-linear edge, a second aligning gauge line proximate said second non-linear edge, said first aligning gauge line and said second aligning gauge line being substantially parallel to said longitudinal axis;

(b) providing pieces of fabric, each of said pieces having an edge;

(c) cutting at least two pieces of said fabric;

(d) overlapping the edges of the two pieces of fabric a predetermined amount such that the edge of the first piece of fabric is underneath the second piece of fabric and the edge of the second piece of fabric is on top of the first piece of fabric;

(e) positioning said first non-linear edge of said pattern measuring device over said fabric such that said first aligning gauge line is coincident with the edge of the second piece of fabric;

(f) cutting said fabric along said first non-linear edge such that said fabric edges have a non-linear pattern;

(g) mating said non-linear edge of said first piece of fabric with said non-linear edge of said second piece of fabric;

(h) sewing said non-linear edges together;

(i) forming a visible seam between said non-linear edges;

(j) repeating steps (c) to (i) to form a block of fabric using only said first non-linear edge of said pattern measuring device;

(k) forming a plurality of fabric blocks; and (l) sewing said fabric blocks together to create a fabric pattern having a visible non-linear pattern.

10. The method of claim 9, wherein said first non-linear edge is a wavy pattern.

11. The method of claim 9, wherein the step of mating said non-linear edge of said first piece of fabric with said non-linear edge of said second piece of fabric further comprises the step of mating a crest of said first piece of fabric with a trough of said second piece of fabric.

12. A method for making a quilt, comprising the steps of:

(a) providing a pattern measuring device comprising a rigid body having a longitudinal axis, a first non-linear edge having a first wavelength and a second non-linear edge of having a second wavelength, said first wavelength and second wavelength being different, a first aligning gauge line proximate said first non-linear edge, a second aligning gauge line proximate said second non-linear edge, said first aligning gauge line and said second aligning gauge line being substantially parallel to said longitudinal axis;

(b) providing pieces of fabric, each of said pieces having an edge;

(c) cutting at least two pieces of fabric;

(d) overlapping the edges of the two pieces of fabric a predetermined amount such that the edge of the first piece of fabric is underneath the second piece of fabric and the edge of the second piece of fabric is on top of the first niece of fabric;

(e) positioning said first non-linear edge of said pattern measuring device over said fabric such that said first aligning gauge line is coincident with the edge of the second piece of fabric;

(f) cutting said fabric along said first non-linear edge such that said fabric edges have a non-linear pattern;

(g) mating said non-linear edge of said first piece of fabric with said non-linear edge of said second piece of fabric by mating a crest of said first piece of fabric with a trough of said second piece of fabric;

(h) sewing said non-linear edges together, (i) forming a visible seam between said non-linear edges (j) repenting steps (c) to (i) to form a block of fabric using only said first non-linear edge of said pattern measuring device;

(k) forming a plurality of fabric blocks; and (l) sewing said fabric blocks together to create a quilt having a visible non-linear pattern.

13. The apparatus of claim 1, wherein only said first non-linear edge is adapted to be used to form the fabric block.

* * * * *